US010427908B2

(12) United States Patent
Krishnamurthy et al.

(10) Patent No.: US 10,427,908 B2
(45) Date of Patent: Oct. 1, 2019

(54) EMERGENCY MODE OPERATION OF ELEVATOR SYSTEM HAVING LINEAR PROPULSION SYSTEM

(71) Applicant: OTIS ELEVATOR COMPANY, Farmington, CT (US)

(72) Inventors: Shashank Krishnamurthy, Glastonbury, CT (US); Daryl J. Marvin, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 547 days.

(21) Appl. No.: 15/099,901

(22) Filed: Apr. 15, 2016

(65) Prior Publication Data

US 2017/0297860 A1 Oct. 19, 2017

(51) Int. Cl.

| | |
|---|---|
| ***B66B 1/34*** | (2006.01) |
| ***B66B 1/32*** | (2006.01) |
| ***B66B 5/02*** | (2006.01) |
| *B66B 9/00* | (2006.01) |
| *B66B 11/04* | (2006.01) |
| *B66B 11/08* | (2006.01) |

(52) U.S. Cl.

CPC ..... *B66B 1/32* (2013.01); *B66B 5/02* (2013.01); *B66B 9/003* (2013.01); *B66B 11/0407* (2013.01); *B66B 11/08* (2013.01)

(58) Field of Classification Search

CPC .. B66B 1/32; B66B 5/02; B66B 9/003; B66B 11/0407; B66B 11/08

USPC ..... 187/247, 248, 249, 287, 288, 289, 293, 187/296, 297, 391, 393, 295

See application file for complete search history.

(56) References Cited

U.S. PATENT DOCUMENTS 4,519,479 A * 5/1985 Tanahashi ..... B66B 5/0031 187/289

5,033,587 A 7/1991 Nakai et al.

(Continued)

FOREIGN PATENT DOCUMENTS

CN 1079368 C 2/2002

CN 101549821 A 10/2009

(Continued)

OTHER PUBLICATIONS

Mel Eye; Mitsubishi Electric Corporation; Mar. 2015; Internet URL: http://www.mitsubishielectric.com/elevator/products/basic/elevators/control_system/pdf/catalog.pdf; 4 pgs.

(Continued)

*Primary Examiner* — Anthony J Salata

(74) *Attorney, Agent, or Firm* — Cantor Colburn LLP

(57) ABSTRACT

An elevator system and/or method executed by an elevator controller for detecting a fault within the elevator system. The elevator controller utilizes the fault to disable a drive control portion of the elevator controller and activate a drive u-stop control portion of the elevator controller. The drive u-stop control portion of the elevator controller generates a signal based on at least one of a speed estimation, a velocity profile, and feedforward information. The elevator controller applies the signal to an inverter connected to the elevator controller to execute the urgent stop of an elevator car of the elevator system.

10 Claims, 4 Drawing Sheets

(56) References Cited

U.S. PATENT DOCUMENTS 5,070,290 A * 12/1991 Iwasa ..... B66B 5/02 187/288
5,276,292 A * 1/1994 Goto ..... B66B 1/308 187/288
5,400,204 A * 3/1995 Oshima ..... B66B 5/0031 187/277
5,717,174 A 2/1998 Ramos
5,877,462 A * 3/1999 Chenais ..... B66B 5/0031 187/249
5,945,644 A 8/1999 Jang
6,264,005 B1 * 7/2001 Kang ..... B66B 5/027 187/290
6,564,907 B1 5/2003 Sasaki
7,353,914 B2 * 4/2008 Deplazes ..... B66B 5/0031 187/249
7,621,376 B2 * 11/2009 Duenser ..... B66B 9/00 187/247
7,650,966 B2 * 1/2010 Sansevero ..... B66B 1/2466 187/249
7,775,327 B2 * 8/2010 Abraham ..... B66B 1/308 187/288
7,896,135 B2 * 3/2011 Kattainen ..... B66B 1/30 187/248
7,896,136 B2 * 3/2011 Shibata ..... B66B 5/02 187/287
8,096,387 B2 * 1/2012 Kattainen ..... B66B 1/30 187/248
8,167,094 B2 * 5/2012 Ueda ..... B66B 5/0031 187/288
8,261,886 B2 * 9/2012 Kigawa ..... B66B 5/00 187/288
8,272,482 B2 9/2012 Takahashi et al.
8,297,409 B2 * 10/2012 Hsu ..... B66B 1/2433 187/247
9,394,139 B2 * 7/2016 Kugiya ..... B66B 1/32
9,434,575 B2 * 9/2016 Kattainen ..... H02P 3/02
9,758,347 B2 * 9/2017 Dudde ..... B66B 9/00
10,035,684 B2 * 7/2018 Roberts ..... B66B 1/2491
2003/0192746 A1 * 10/2003 Suzuki ..... B66B 5/0037 187/391
2007/0029141 A1 2/2007 Chida
2007/0056806 A1 3/2007 Okamoto et al.
2007/0170010 A1 7/2007 Higashinaka
2012/0073909 A1 * 3/2012 Kondo ..... B66B 1/32 187/247
2013/0264149 A1 10/2013 Okamoto et al.
2017/0073183 A1 * 3/2017 Ginsberg ..... B66B 5/06

FOREIGN PATENT DOCUMENTS

CN 101950978 A 1/2011
CN 104210982 A 12/2014

OTHER PUBLICATIONS

Schlinder, Emergency Operation of Elevator Systems; Internet URL: http://www.schindler.com/content/us/internet/en/service-maintenance/_jcr_content/rightPar/downloadlist/downloadList/189_1336163651964.download.asset.189_1336163651964/cmn1028emergops.pdf.

* cited by examiner

EMERGENCY MODE OPERATION OF ELEVATOR SYSTEM HAVING LINEAR PROPULSION SYSTEM

BACKGROUND

Conventional roped/belted elevator systems utilize a mechanical brake to stop an elevator car in an emergency mode. In some alternative elevator systems, such as those with no counterweight and with a linear electromagnetic actuation scheme, the use of a traditional mechanical brake may result in undesirable and dangerous braking forces. Thus, an architecture to stop the elevator car of these alternative elevator systems in the emergency mode is desirable.

SUMMARY

According to one embodiment, a method is provided. The method comprises detecting, by an elevator controller, a fault within an elevator system; utilizing, by the elevator controller, the fault to disable a drive control portion of the elevator controller and activate a drive u-stop control portion of the elevator controller; generating, by the drive u-stop control portion of the elevator controller, a signal based on at least one of a speed estimation, a velocity profile, and feedforward information; and applying, by the elevator controller, the signal to an inverter connected to the elevator controller to execute the urgent stop of an elevator car of the elevator system.

According to an embodiment or the above embodiment, the fault can include a loss of power to the elevator system.

According to another embodiment or any of the above embodiments, the fault can include a non-connected state of the safety chain status.

According to another embodiment or any of the above embodiments, a selector can disconnect the drive control portion of the elevator controller from the inverter.

According to another embodiment or any of the above embodiments, a selector can connect the drive u-stop control portion of the elevator controller to the inverter.

According to another embodiment or any of the above embodiments, the elevator system can be a roped or belted elevator system.

According to another embodiment or any of the above embodiments, the elevator system can include a linear electromagnetic actuation scheme comprising the elevator controller.

According to one embodiment, an elevator system is provided. The elevator system comprising an elevator controller configured to perform detecting a fault within the elevator system; utilizing the fault to disable a drive control portion of the elevator controller and activate a drive u-stop control portion of the elevator controller; generating, by the drive u-stop control portion of the elevator controller, a signal based on at least one of a speed estimation, a velocity profile, and feedforward information; and applying the signal to an inverter connected to the elevator controller to execute the urgent stop of an elevator car of the elevator system.

According to an embodiment or the above embodiment, the fault can include a loss of power to the elevator system.

According to another embodiment or any of the above embodiments, the fault can include a non-connected state of the safety chain status.

According to another embodiment or any of the above embodiments, a selector can disconnect the drive control portion of the elevator controller from the inverter.

According to another embodiment or any of the above embodiments, a selector can connect the drive u-stop control portion of the elevator controller to the inverter.

According to another embodiment or any of the above embodiments, the elevator system can be a roped or belted elevator system.

According to another embodiment or any of the above embodiments, the elevator system can include a linear electromagnetic actuation scheme comprising the elevator controller.

Additional features and advantages are realized through the techniques of the present disclosure. Other embodiments and aspects of the disclosure are described in detail herein. For a better understanding of the disclosure with the advantages and the features, refer to the description and to the drawings.

BRIEF DESCRIPTION OF THE SEVERAL VIEWS OF THE DRAWINGS

The subject matter is particularly pointed out and distinctly claimed in the claims at the conclusion of the specification. The forgoing and other features, and advantages of the embodiments herein are apparent from the following detailed description taken in conjunction with the accompanying drawings in which:

DETAILED DESCRIPTION

Embodiments relate generally to an electronic system architecture for emergency mode operation of elevators and, more particularly, to an elevator system that utilizes a linear electromagnetic actuator of the electronic system architecture to stop an elevator car in an emergency.

In general, embodiments disclosed herein may include system, method, and/or computer program product (herein collectively referred to as a "system") that receives position feedback information from each of a plurality of motor segments and takes over operations by executing an urgent stop. In one embodiment, the system can be an elevator system that comprises control hardware/software co-located with each inverter of a linear electromagnetic actuation scheme of the elevator system. This control hardware can comprise a controller circuit that receives the position feedback information from each motor segment of the elevator system. In the event of an urgent stop command, the controller circuit can commandeer operations of the inverter by disabling a normal operating mode of the elevator system and executing the urgent stop (e.g., performing the necessary duty cycle and IGBT gate signal generation).

Figure 1:
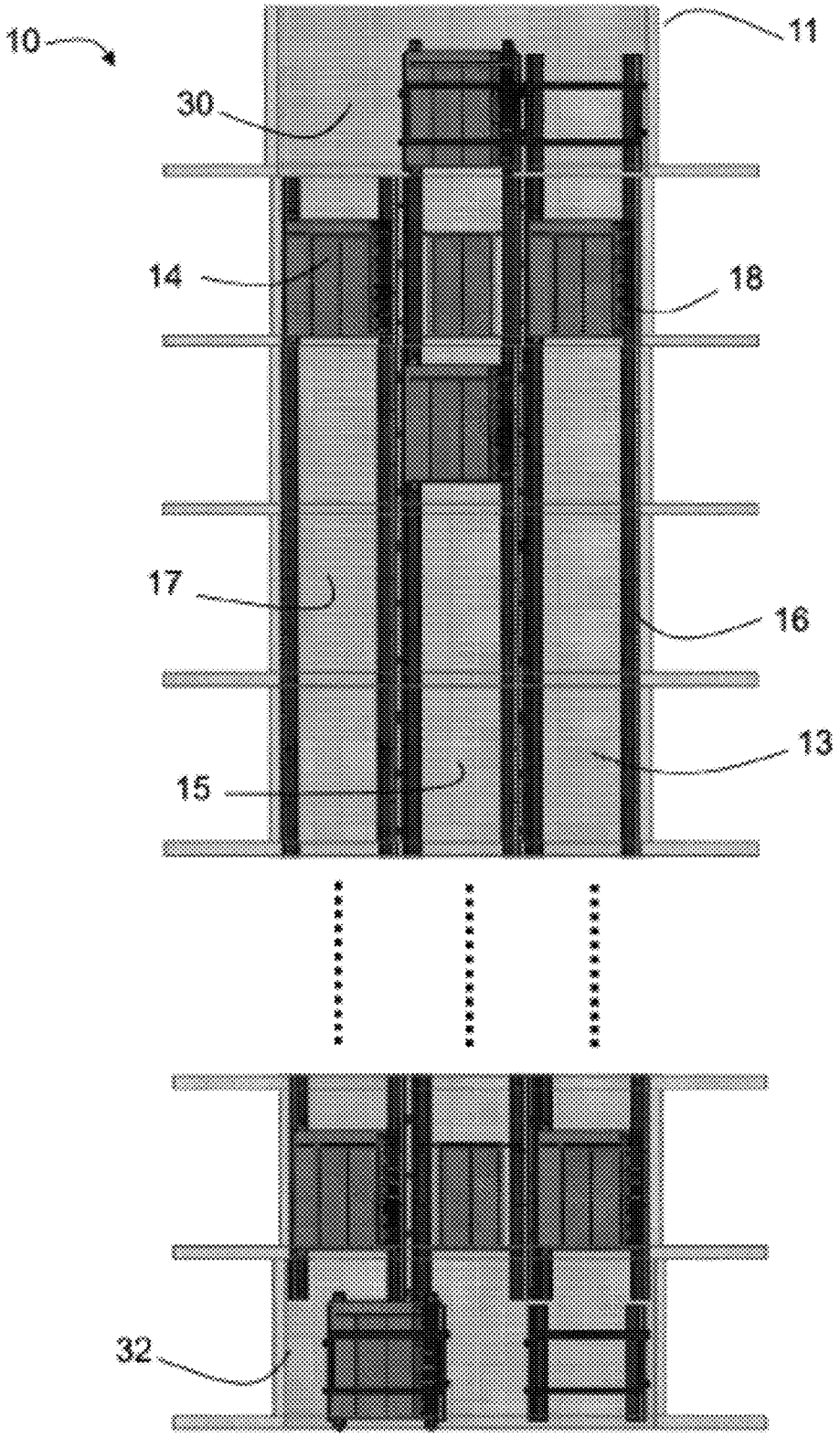
FIG. 1 illustrates an example of a schematic of an elevator system according to one embodiment.

Referring now to FIG. 1, the system is depicted as a multicar, ropeless elevator system 10 according to an embodiment. The multicar, ropeless elevator system 10 includes a hoistway 11 having a plurality of lanes 13, 15 and 17. While three lanes are shown in FIG. 1, it is understood that embodiments may be used with multicar ropeless elevator systems that have any number of lanes. In each lane 13, 15, 17, cars 14 may travel in one direction, i.e., up or down or both directions. For example, in FIG. 1 cars 14 in lanes 13 and 15 travel up and cars 14 in lane 17 travel down. One or more cars 14 may travel in a single lane 13, 15, and 17.

Above the top floor is an upper transfer station 30 to impart horizontal motion to elevator cars 14 to move elevator cars 14 between lanes 13, 15 and 17. It is understood that upper transfer station 30 may be located at the top floor, rather than above the top floor. Below the first floor is a lower transfer station 32 to impart horizontal motion to elevator cars 14 to move elevator cars 14 between lanes 13, 15 and 17. It is understood that lower transfer station 32 may be located at the first floor, rather than below the first floor. Although not shown in FIG. 1, one or more intermediate transfer stations may be used between the first floor and the top floor. Intermediate transfer stations are similar to the upper transfer station 30 and lower transfer station 32.

Cars 14 are propelled using a linear motor system (a.k.a. a linear propulsion system or linear electromagnetic actuation scheme) having a primary, fixed portion 16 and a secondary, moving portion 18. The primary portion 16 includes windings or coils mounted at one or both sides of the lanes 13, 15 and 17. Secondary portion 18 includes permanent magnets mounted to one or both sides of cars 14. Primary portion 16 is supplied with drive signals to control movement of cars 14 in their respective lanes.

Figure 2:
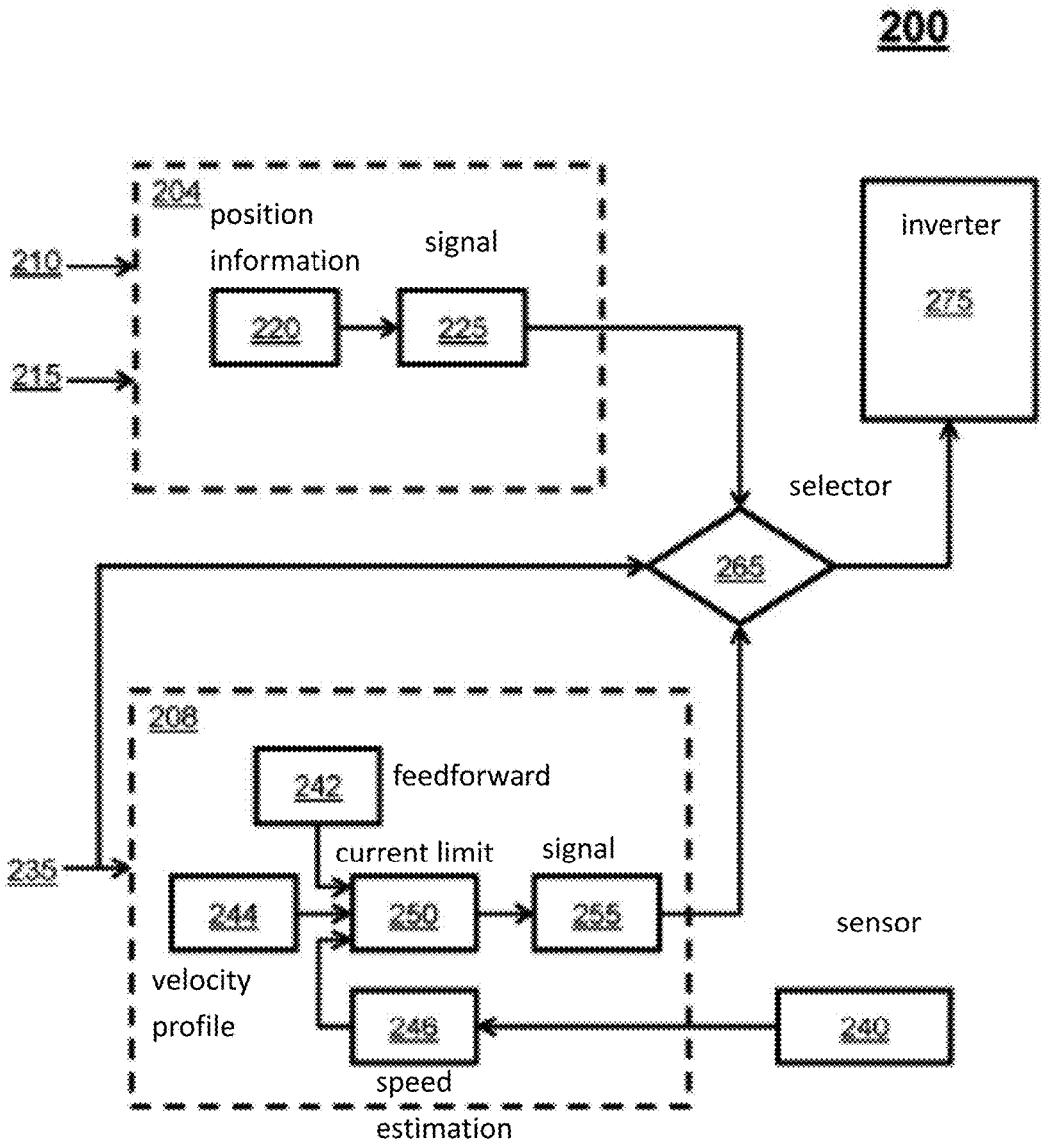
FIG. 2 illustrates an example of control schematic of a linear electromagnetic actuation scheme of an elevator system according to one embodiment.

Referring now to FIG. 2, an example of control schematic 200 of the linear electromagnetic actuation scheme of the system (e.g., the multicar, ropeless elevator system 10) according to one embodiment is depicted. In general, the control schematic 200 comprises a control hardware/software that is co-located with each inverter for a linear electromagnetic actuation scheme. Thus, the control schematic 200 can be implemented in hardware, software, or any combination thereof (e.g., such as being implemented through hardware and software on the computing device 409 described below with respect to FIG. 4). The control schematic 200 can include a drive normal control 204 and a drive u-stop control 208, both of which can be implemented as hardware, software, or any combination thereof (e.g., such as being program modules 428 on the computing device 409).

The drive normal control 204 receives as inputs position information 210 from an electrical sub-system of the system and a current command 215 from a vehicle control of the system. The position information 210 and the current command 215 are feedback information from each motor segment of the linear electromagnetic actuation scheme. The drive normal control 204 further processes these signals with respect to a propulsion intake regulator current limit 220 to produce a duty ratio pulse width modulation signal 225. Note that the current limit is variable based on a size of the control schematic 200. In an embodiment, the current limit can be at least two times a rated current of the control schematic 200. In one embodiment, the current limit may be equal to or less than two times a rated current of the control schematic 200.

The drive u-stop (also referred to as urgent stop) control 208 receives as an input a safety chain status 235 and a speed indication from a sensor 340. As a result, all the safety related software and hardware can be localized in the drive u-stop control 208.

The safety chain status 235 can comprise a signal or output corresponding to the operations of a safety chain associated with an elevator car. In general, a safety chain is a Boolean device that indicated whether the associated elevator car is in a safe state. For example, if the elevator is in a safe state, the safety chain can output an 'on' signal. Further, if the elevator is not in a safe state, the safety chain can output an 'off' signal. Note that multiple signals, such as door status, power, terminal landings, etc., can be combined to form the safety chain status 235.

The sensor 240 can comprise any device that detects events or changes in quantities and provides a corresponding output, e.g., as an electrical or optical signal. Examples of quantities that a sensor can detect include, but are not limited to light, motion, temperature, magnetic fields, gravity, humidity, moisture, vibration, pressure, electrical fields, sound, and other physical aspects of an external environment. Thus, for example, the sensor 350 can comprise an accelerometer associated elevator car and in communication with the drive u-stop control 208 to provide a speed status or speed indication of the associated elevator car.

Further, based on the safety chain status 235 and the speed indication from the sensor 240, the drive u-stop control 208 processes a feedforward 242, a velocity profile 244, and a speed estimation 246 with respect to a propulsion intake regulator current limit 250 to produce a duty ratio pulse width modulation signal 255.

The feedforward 242 includes processing predetermined attributes of the elevator car, such as a weight and possible load of the elevator car, such that the drive u-stop control 208 can determine current limits and generate a duty ratio. In general, feedforward 242 can include a mechanism within the control schematic 200 that passes a controlling signal from a source (e.g., from any element within or external to the control schematic 200) to a load (e.g., the propulsion intake regulator current limit 250).

The velocity profile 244 is an estimated trajectory for slowing and stopping the elevator car while maintaining a comfortable ride for occupants of the elevator car. For example, the velocity profile 244 can utilize a variable maximum deceleration rate to slow and stop the elevator car.

The speed estimation 246 is an algorithmic estimator that utilizes trade-offs between physically detecting dynamics of the elevator car and calculating these dynamics. In an embodiment, the algorithm can utilize motor currents and commanded voltages to estimate a position of an elevator car, which is used for the velocity profile 244. In turn, the algorithm can provide a redundant mechanism to measure position, which is needed for safety.

Based on the safety chain status 235, one of the outputs (e.g., the signal 225 from the drive normal control 204 or the signal 255 from the drive u-stop control 208) is passed by a selector 265 to the inverter 275. In an embodiment, the outputs can be selector signals that decide which input to feed through. That is, the signal 225 and 255 are status signals of the safety chain, where based on whether the system is safe or not the control schematic 200 can utilize a normal control (e.g., drive normal control 204) or a ustop/safety control (e.g., drive u-stop control 208).

For example, the safety chain status 235 can indicate two states: connected and non-connected. If safety chain status 235 indicates the connected state, then the selector 265 passes the signal 225 from the drive normal control 204 to the inverter 275. If the safety chain status 235 indicates the non-connected state, then the selector 265 passes the signal 255 from the drive u-stop control 208 to the inverter 275.

Figure 3:
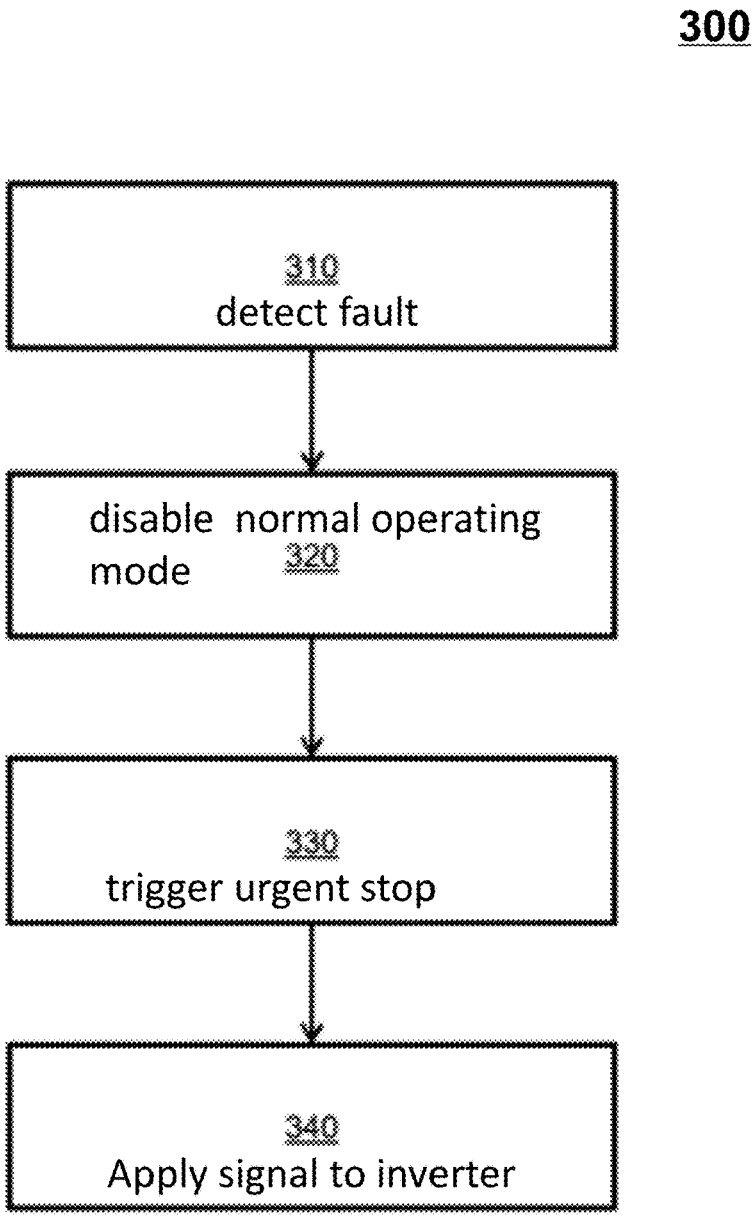
FIG. 3 illustrates a process flow by an elevator system according to one embodiment.

Operations of the control schematic 200 will now be described with respect to FIG. 3, which illustrates an exemplary process flow 300. In general, the process flow 300 illustrates that, in the event of an urgent stop command, the drive u-stop control 208 commandeer operations of the inverter 270.

The process flow 300 begins at block 310 where the control schematic 200 of the linear electromagnetic actuation scheme of the system detects a fault. The fault can include a loss of power, a sudden drop of an elevator car, a signal based on the operation of the safety chain status 235, or any other fault. In an embodiment, the control schematic 200 detects, as the fault, the non-connected state of the safety chain status 235.

At block 320, the control schematic 200 utilizes the non-connected state of the safety chain status 235 to disable a normal operating mode. For instance, the selector 265 disconnects the signal 225 from the drive normal control 204 to the inverter 275.

At block 330, the control schematic 200 utilizes the drive u-stop control 208 to trigger an urgent stop. To trigger the urgent stop, the drive u-stop control 208 generates a duty cycle and insulated-gate bipolar transistor (IGBT) gate signal.

At block 340, the control schematic 200 executes the urgent stop by applying the signal generated by the drive u-stop control 208 to the inverter 275. That is, the inverter utilizes the duty cycle and IGBT gate signal receives from the drive u-stop control 208 to execute the urgent stop. For example, the control schematic 200 can output a voltage based on a desired output current (note that the duty signals are representative of the output voltage that needs to be generated). A duty signal is compared to a carrier waveform to generate a desired IGBT signal, which can be considered a pulse width modulation. The IGBT signal, further, controls the output voltage and, in turn, the duty signal is translated to output voltage.

Figure 4:
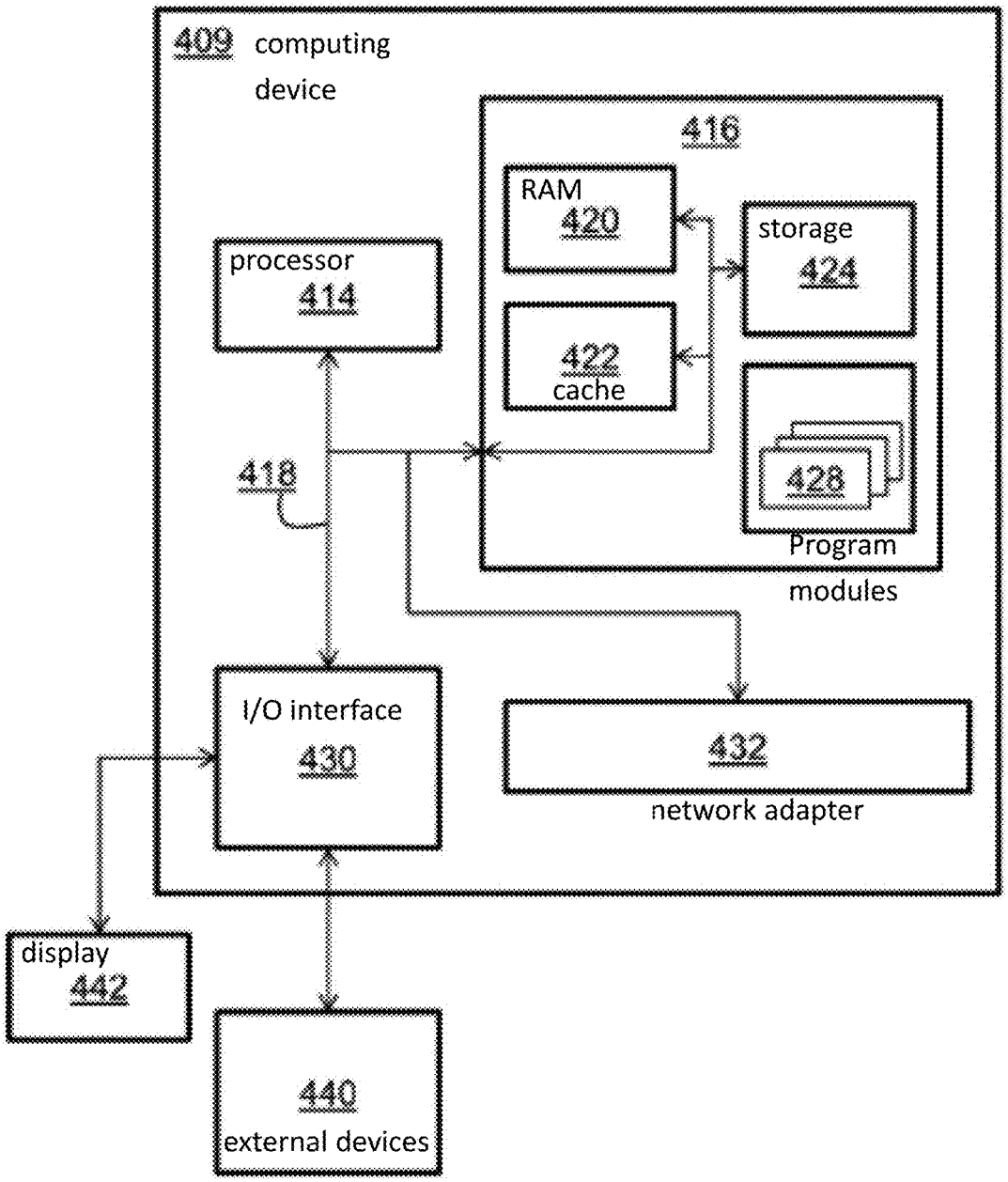
FIG. 4 illustrates a computing device schematic of an elevator system according to one embodiment.

Referring now to FIG. 4, an example schematic of a computing device 409 of the system is shown. The computing device 409 is only one example of a suitable computing node and is not intended to suggest any limitation as to the scope of use or operability of embodiments described herein (indeed additional or alternative components and/or implementations may be used). That is, the computing device 409 and elements therein may take many different forms and include multiple and/or alternate components and facilities. Further, the computing device 409 may be any and/or employ any number and combination of computing devices and networks utilizing various communication technologies, as described herein. Regardless, the computing device 409 is capable of being implemented and/or performing any of the operations set forth hereinabove.

The computing device 409 can be operational with numerous other general-purpose or special-purpose computing system environments or configurations. Systems and/or computing devices, such as the computing device 409, may employ any of a number of computer operating systems. Examples of computing systems, environments, and/or configurations that may be suitable for use with the computing device 409 include, but are not limited to, personal computer systems, server computer systems, thin clients, thick clients, handheld or laptop devices, multiprocessor systems, microprocessor-based systems, programmable logic circuitry, field-programmable gate arrays (FPGA), or programmable logic arrays (PLA), set top boxes, programmable consumer electronics, network PCs, minicomputer systems, computer workstations, servers, desktops, notebooks, network devices, mainframe computer systems, mobile devices, and distributed cloud computing environments that include any of the above systems or devices, and the like.

The computing device 409 may be described in the general context of computer system executable instructions, such as program modules, being executed by a computer system. Generally, program modules may include routines, programs, objects, components, logic, data structures, and so on that perform particular tasks or implement particular abstract data types. The computing device 409 may be practiced in distributed cloud computing environments where tasks are performed by remote processing devices that are linked through a communications network. In a distributed cloud computing environment, program modules may be located in both local and remote computer system storage media including memory storage devices.

As shown in FIG. 4, the computing device 409 is in the form of a general-purpose computing device that is improved upon by the operation and functionality of the computing device 409, its methods, and/or elements thereof. The components of the computing device 409 may include, but are not limited to, one or more processors or processing units (e.g., processor 414), a memory 416, and a bus (or communication channel) 418 which may take the form of a bus, wired or wireless network, or other forms, that couples various system components including the processor 414 and the system memory 416. The computing device 409 also typically includes a variety of computer system readable media. Such media may be any available media that is accessible by the computing device 409, and it includes both volatile and non-volatile media, removable and non-removable media.

The processor 414 may receive computer readable program instructions from the memory 416 and execute these instructions, thereby performing one or more processes defined above. The processor 414 may include any processing hardware, software, or combination of hardware and software utilized by the computing device 414 that carries out the computer readable program instructions by performing arithmetical, logical, and/or input/output operations. Examples of the processor 414 include, but are not limited to an arithmetic logic unit, which performs arithmetic and logical operations; a control unit, which extracts, decodes, and executes instructions from a memory; and an array unit, which utilizes multiple parallel computing elements.

The memory 416 may include a tangible device that retains and stores computer readable program instructions, as provided by the multicar, ropeless elevator system 10 and the control schematic 200, for use by the processor 414 of the computing device 409. The memory 416 can include computer system readable media in the form of volatile memory, such as random access memory 420, cache memory 422, and/or a storage system 424.

By way of example only, the storage system 424 can be provided for reading from and writing to a non-removable, non-volatile magnetic media (not shown and typically called a "hard drive", either mechanical or solid-state). Although not shown, a magnetic disk drive for reading from and writing to a removable, non-volatile magnetic disk (e.g., a "floppy disk"), and an optical disk drive for reading from or writing to a removable, non-volatile optical disk such as a CD-ROM, DVD-ROM or other optical media can be provided. In such instances, each can be connected to the bus 418 by one or more data media interfaces. As will be further depicted and described below, the memory 416 may include at least one program product having a set (e.g., at least one) of program modules that are configured to carry out the operations of embodiments herein. The storage system 424 (and/or memory 416) may include a database, data repository or other data store and may include various kinds of mechanisms for storing, accessing, and retrieving various kinds of data, including a hierarchical database, a set of files in a file system, an application database in a proprietary format, a relational database management system (RDBMS), etc. The storage system 424 may generally be included within the computing device 409, as illustrated, employing a computer operating system such as one of those mentioned above, and is accessed via a network in any one or more of a variety of manners.

Program/utility 426, having a set (at least one) of program modules 428, may be stored in memory 416 by way of example, and not limitation, as well as an operating system, one or more application programs, other program modules, and program data. Each of the operating system, one or more application programs, other program modules, and program data or some combination thereof, may include an implementation of a networking environment. Program modules 428 generally carry out the operations and/or methodologies of embodiments as described herein (e.g., the process flow 300).

The bus 418 represents one or more of any of several types of bus structures, including a memory bus or memory controller, a peripheral bus, an accelerated graphics port, and a processor or local bus using any of a variety of bus architectures. By way of example, and not limitation, such architectures include Industry Standard Architecture (ISA) bus, Micro Channel Architecture (MCA) bus, Enhanced ISA (EISA) bus, Video Electronics Standards Association (VESA) local bus, and Peripheral Component Interconnect (PCI) bus.

The computing device 409 may also communicate via an input/output (I/O) interface 430 and/or via a network adapter 432. The I/O interface 430 and/or the network adapter 432 may include a physical and/or virtual mechanism utilized by the computing device 409 to communicate between elements internal and/or external to the computing device 409. For example, the I/O interface 430 may communicate with one or more external devices 440 (e.g., the user device), such as a keyboard, a pointing device, a display 442 (e.g., the display), etc.; one or more devices that enable a user to interact with the computing device 409; and/or any devices (e.g., network card, modem, etc.) that enable the computing device 409 to communicate with one or more other computing devices. Further, the computing device 409 can communicate with one or more networks such as a local area network (LAN), a general wide area network (WAN), and/or a public network (e.g., the Internet) via network adapter 432. Thus, I/O interface 430 and/or the network adapter 432 may be configured to receive or send signals or data within or for the computing device 409. As depicted, the I/O interfaces 430 and the network adapter 432 communicates with the other components of the computing device 409 via the bus 418. It should be understood that although not shown, other hardware and/or software components could be used in conjunction with the computing device 409. Examples, include, but are not limited to: microcode, device drivers, redundant processing units, external disk drive arrays, RAID systems, tape drives, and data archival storage systems, etc.

While single items are illustrated for the multicar, ropeless elevator system 10, the control schematic 200, the process flow 300, and the computing device 409 (and other items) by the Figures, these representations are not intended to be limiting and thus, any items may represent a plurality of items. In general, computing devices may include a processor (e.g., a processor 414 of FIG. 4) and a computer readable storage medium (e.g., a memory 416 of FIG. 4), where the processor receives computer readable program instructions, e.g., from the computer readable storage medium, and executes these instructions, thereby performing one or more processes, including one or more of the processes described herein.

In this way, the embodiments herein improve upon existing building and elevator schemes by adding/modifying operations and/or devices of those schemes to provide a clear distinction between elements that operate under a normal mode and elements that operate under urgent stop mode, which results in an inverter system architecture that has an overall lower cost to develop, maintain, and certify. Thus, technical effects and benefits include, for example, the urgent stop elements (e.g., hardware and/or software) can undergo safety certifications that do not affect the normal mode elements. Further, the technical effects and benefits include enabling future upgrades to improve operating performance of the urgent stop elements at a lower cost. Note that the above embodiments can be applied to conventional roped/belted elevator systems, as well as alternative elevator systems (such as those with no counterweight and with a linear electromagnetic actuation scheme).

Embodiments may include a system, a method, and/or a computer program product at any possible technical detail level of integration. The computer program product may include a computer readable storage medium (or media) having computer readable program instructions thereon for causing a processor to carry out aspects of the embodiments herein.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the embodiments herein may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the embodiments herein.

Aspects of the embodiments are described herein with reference to flowchart illustrations and/or block diagrams of methods, apparatus (systems), and computer program products. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments herein. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one more other features, integers, steps, operations, element components, and/or groups thereof.

The descriptions of the various embodiments herein have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A method, comprising:

detecting, by an elevator controller, a fault within an elevator system;

utilizing, by the elevator controller, the fault to disable a drive control portion of the elevator controller and activate a drive urgent stop control portion of the elevator controller;

generating, by the drive urgent stop control portion of the elevator controller, a signal based on at least one of a speed estimation, a velocity profile, and feedforward information; and applying, by the elevator controller, the signal to an inverter connected to a linear propulsion system to execute the urgent stop of an elevator car of the elevator system;

the linear propulsion system comprising a primary portion including a plurality of coils configured to receive power from the inverter and a secondary portion including permanent magnets, one of the primary portion and the secondary portion mounted to the elevator car.

2. The method of claim 1, wherein the fault includes a loss of power to the elevator system.

3. The method of claim 1, wherein the fault includes a non-connected state of the safety chain status.

4. The method of claim 1, wherein a selector disconnects the drive control portion of the elevator controller from the inverter.

5. The method of claim 1, wherein a selector connects the drive urgent stop control portion of the elevator controller to the inverter.

6. An elevator system comprising an elevator controller configured to perform:

detecting a fault within the elevator system;

utilizing the fault to disable a drive control portion of the elevator controller and activate a drive urgent stop control portion of the elevator controller;

generating, by the drive urgent stop control portion of the elevator controller, a signal based on at least one of a speed estimation, a velocity profile, and feedforward information; and applying the signal to an inverter connected to a linear propulsion system to execute the urgent stop of an elevator car of the elevator system;

the linear propulsion system comprising a primary portion including a plurality of coils configured to receive power from the inverter and a secondary portion including permanent magnets, one of the primary portion and the secondary portion mounted to the elevator car.

7. The elevator system of claim 6, wherein the fault includes a loss of power to the elevator system.

8. The elevator system of claim 6, wherein the fault includes a non-connected state of the safety chain status.

9. The elevator system of claim 6, wherein a selector disconnects the drive control portion of the elevator controller from the inverter.

10. The elevator system of claim 6, wherein a selector connects the drive urgent stop control portion of the elevator controller to the inverter.

* * * * *